US007614452B2

(12) United States Patent
Kenison et al.

(10) Patent No.: US 7,614,452 B2
(45) Date of Patent: Nov. 10, 2009

(54) FLOW REVERSING APPARATUS AND METHODS OF USE

(75) Inventors: Michael H. Kenison, Missouri City, TX (US); Michael G. Gay, Dickinson, TX (US); Robert Bucher, Houston, TX (US); Mahmuda Afroz, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 454 days.

(21) Appl. No.: 11/151,605

(22) Filed: Jun. 13, 2005

(65) Prior Publication Data

US 2006/0278395 A1 Dec. 14, 2006

(51) Int. Cl.
*E21B 34/10* (2006.01)
*E21B 47/04* (2006.01)

(52) U.S. Cl. ..... 166/321; 166/332.8; 166/374; 166/250.03; 251/298

(58) Field of Classification Search ..... 166/332.8, 166/323, 325, 319, 321, 324, 332.7, 373–375, 166/250.01, 250.03, 250.12, 386; 251/228, 251/298; 137/247.19, 527
See application file for complete search history.

(56) References Cited

U.S. PATENT DOCUMENTS

| | | | | |
|---|---|---|---|---|
| 4,069,871 | A | 1/1978 | Page, Jr. | |
| 5,170,815 | A | 12/1992 | Going, III et al. | |
| 6,328,112 | B1 * | 12/2001 | Malone | 166/386 |
| 6,604,582 | B2 * | 8/2003 | Flowers et al. | 166/332.1 |
| 6,619,388 | B2 * | 9/2003 | Dietz et al. | 166/66.7 |
| 6,808,023 | B2 * | 10/2004 | Smith et al. | 166/386 |
| 6,834,722 | B2 | 12/2004 | Vacik et al. | 166/321 |
| 6,883,605 | B2 | 4/2005 | Arceneaux et al. | 166/171 |
| 6,889,771 | B1 | 5/2005 | Leising et al. | 166/373 |
| 2002/0100585 | A1 | 8/2002 | Spiers et al. | |
| 2004/0040707 | A1 * | 3/2004 | Dusterhoft et al. | 166/279 |

FOREIGN PATENT DOCUMENTS

| | | |
|---|---|---|
| GB | 2362407 | 11/2001 |
| GB | 2391239 | 2/2004 |

* cited by examiner

*Primary Examiner*—Kenneth Thompson
(74) *Attorney, Agent, or Firm*—Michael Flynn; David Cate; Robin Nava

(57) ABSTRACT

Apparatus and methods for selectively and safely reversing flow in coiled tubing used for wellbore cleanouts are disclosed. One apparatus includes a section of coiled tubing having a main flow channel, at least two flow-preventing valves in the section of coiled tubing, each adapted to close the main flow channel upon attempted flow reversal; and at least one actuator adapted to deter closing of the flow-preventing valves. This abstract allows a searcher or other reader to quickly ascertain the subject matter of the disclosure. It will not be used to interpret or limit the scope or meaning of the claims. 37 CFR 1.72(b).

35 Claims, 9 Drawing Sheets

FLOW REVERSING APPARATUS AND METHODS OF USE

BACKGROUND OF THE INVENTION

1. Field of Invention

The present invention relates generally to the field of well cleaning, and more specifically to modified coiled tubing apparatus and methods of using same in well cleaning operations.

2. Related Art

The ability to pump fluid while conveying tools makes wellbore cleanouts a natural application for coiled tubing (CT). During a conventional cleanout, fluid is pumped through the CT, often across a nozzle, and into the annulus, lifting solid particles to surface. Certain well types or conditions, however, make conventional cleanouts difficult or ineffective. For example, in wells where the CT outside diameter is small relative to the annulus internal diameter, it may be difficult to achieve the flow rate needed to lift particles in the annulus as the annular velocity is quite low.

In wells where conventional cleanouts are impractical, reverse circulation sometimes provides a means to lift solids to the surface. In reverse circulation, fluid at surface is pumped into the annulus, where it then flows down the well and into the CT, lifting particles in the process. Because the fluid velocity in the CT is much higher than in the annulus at the same flow rate, particles are more easily suspended and moved along. Using standard surface equipment, the particles are collected and disposed of with minimal disruption to normal well processes.

The main concern with reverse circulating is the safety risk associated with allowing fluid to flow from downhole to surface through the CT. A potential well must meet strict qualifications before a reverse cleanout is performed in order to minimize this risk. Current reversing tools are not adequate in many situations since they require either CT manipulation or pumping to return to a safe position, a hazardous situation arises if these functions are lost during the job. Also, presently known reversing tools can potentially allow hydrocarbons to flow up the CT to surface; the hydrocarbons can only be detected when they reach surface and already present a potential well control situation.

From the above it is evident that there is a need in the art for improvement in well cleaning.

SUMMARY OF THE INVENTION

In accordance with the present invention, apparatus (also referred to herein as reversing tools, or simply tools) and methods are described that reduce or overcome problems in previously known apparatus and methods.

A first aspect of the invention are apparatus comprising:

An apparatus comprising:

(a) a section of coiled tubing having a main flow passage;

(b) at least two flow-preventing valves in the section of coiled tubing, each adapted to close the main flow passage upon attempted flow reversal; and (c) at least one actuator adapted to deter closing of the flow-preventing valves.

Apparatus of the invention include those apparatus wherein the reversing tool apparatus may be referred to as "intrinsically safe", in that they do not rely on pumping or CT manipulation to return to a safe mode of operation. The inventive apparatus and methods employ one or more forms of actuation, for example motor and solenoid actuators. Motors and solenoids may be used with several types of mechanical systems to achieve the desired result.

The inventive apparatus may further include a hydraulic system used in conjunction with these actuation systems. A pressure lock piston, forced up by a spring, may allow hydraulic fluid to flow freely into a compensation chamber, so that there is no pressure differential across a hydraulic fluid check valve, which may be a ball and spring combination. In its down position, the pressure lock piston only allows flow across the hydraulic fluid check valve in one direction, from the compensation chamber into a high pressure chamber. The pressure lock piston is normally forced up by the spring. When the hydraulic fluid pressure above pressure lock piston is higher than the annulus (outside the tool) pressure below the piston, the spring can be overridden and pressure lock piston may move down. When a pressure differential is seen across the hydraulic fluid check valve assembly, a solenoid may be activated, causing its actuator to move toward a ball to roll the ball off its seat and release the hydraulic pressure. A compensating piston may provide an adequate supply of hydraulic fluid for the system. The compensating piston allows for direct pressure transfer from the tool ID above a flow-preventing valve to the hydraulic fluid.

Apparatus of the invention may include surface/tool communication through one or more communication links, including but not limited to hard wire, optical fiber, radio, or microwave transmission. The inventive apparatus and methods may include a chemical detector at the tool level, which enables an operator to stop reversing long before hydrocarbons or other chemicals can reach surface and pose a safety risk. The chemical detector, if used, may be selected from any functioning system, or future functioning system, or combination of systems.

Another aspect of the invention is a method, one method of the invention comprising:

(a) inserting a coiled tubing having a main flow channel into a bore hole, the coiled tubing comprising a section of coiled tubing having at least two flow-preventing valves;

(b) initiating flow of a fluid through an annulus between the coiled tubing and the well bore; and (c) reversing flow through the coiled tubing by actuating at least one actuator to deter closing of the flow-preventing valves.

Methods of the invention include those comprising sensing a chemical, such as a hydrocarbon, in the reverse flow.

Apparatus and methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which:

FIGS. 3A, 2B, 3C, and 3D are schematic cross-sectional views of the hydraulic system of FIG. 3 in different modes of operation;

Figure 1A:
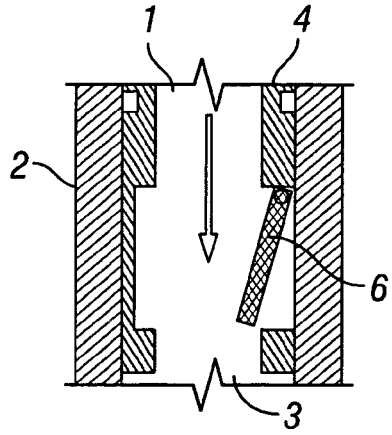
FIG. 1A (Prior Art)
FIGS. 1A and 1B are schematic cross-sectional views of a prior art flapper check valve useful in the invention.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes modified coiled tubing (CT) apparatus and methods for cleaning wellbores using same. As used herein the term "cleaning" means removing, or attempting to remove, unwanted material in a wellbore. A "wellbore" may be any type of well, including, but not limited to, a producing well, a non-producing well, an experimental well, and exploratory well, and the like. Wellbores may be vertical, horizontal, some angle between vertical and horizontal, and combinations thereof, for example a vertical well with a non-vertical component. During a conventional cleanout, fluid is pumped through the CT, often across a nozzle, and into the annulus, lifting solid particles to surface. Certain well types or conditions, however, make conventional cleanouts difficult or ineffective. For example, in wells where the CT outside diameter is small relative to the well internal diameter, it may be difficult to achieve the flow rate needed to lift particles in the annulus as the annular velocity is quite low. In wells where conventional cleanouts are impractical, reverse circulation sometimes provides a means to lift solids to the surface. In reverse circulation, fluid at surface is pumped into the annulus, where it then flows down the well and into the CT, lifting particles in the process. Because the fluid velocity in the CT is much higher than in the annulus at the same flow rate, particles are more easily suspended and moved along. Using standard surface equipment, the particles are collected and disposed of with minimal disruption to normal well processes. The main concern with reverse circulating is the safety risk associated with allowing fluid to flow from downhole to surface through the CT. A potential well must meet strict qualifications before a reverse cleanout is performed in order to minimize this risk. Current reversing tools are not adequate in many situations since they require either CT manipulation or pumping to return to a safe position, a hazardous situation arises if these functions are lost during the job. Also, presently known reversing tools can potentially allow hydrocarbons to flow up the CT to surface; the hydrocarbons can only be detected when they reach surface and already present a potential well control situation.

Given that safety is a primary concern, and that there is considerable investment in existing equipment, it would be an advance in the art if reverse well cleanouts could be performed using existing apparatus modified to increase safety and efficiency during the cleaning procedures, with minimal interruption of other well operations. This invention offers methods and apparatus for these purposes. The American Petroleum Institute (API) requires that downhole tools be equipped with two barriers that independently prevent fluid from flowing back to surface through the CT. These barriers usually take the form of check valves. If fluid flows downhole, the valves will open, providing minimal interference. If fluid starts to move uphole, however, the valves close to prevent flow.

Figure 1B:
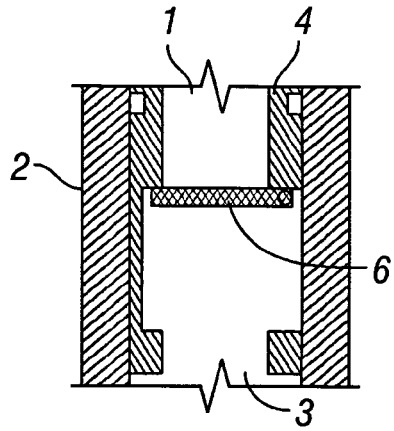
FIG. 1B (Prior Art)

Referring now to the figures, FIGS. 1A and 1B illustrate schematically and not to scale cross-sectional views of a prior art flapper check valve useful in the invention positioned in a CT. Illustrated in FIG. 1A is an open flapper check valve comprised of an insert 4 and movable flapper 6. Insert 4 has an opening 1 allowing fluid to pass through the check valve and out through a second opening 3. Insert 4 is positioned inside a CT wall 2. FIG. 1B illustrates a closed check valve, for example when fluid attempts to reverse flow from opening 3 to opening 1.

Figure 2A:
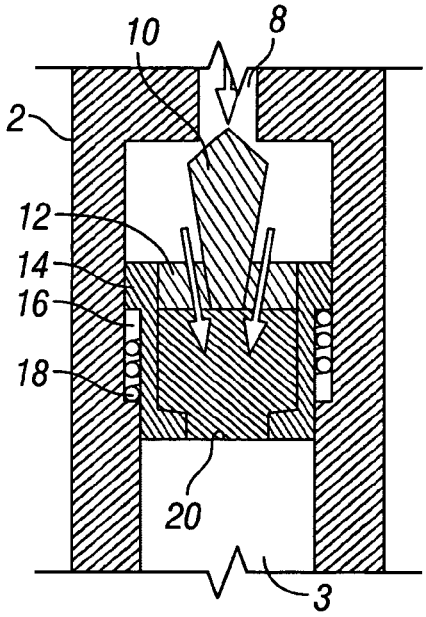
FIG. 2A (Prior Art)
FIGS. 2A and 2B are schematic cross-sectional views of a prior art dart valve useful in the invention.
Figure 2B:
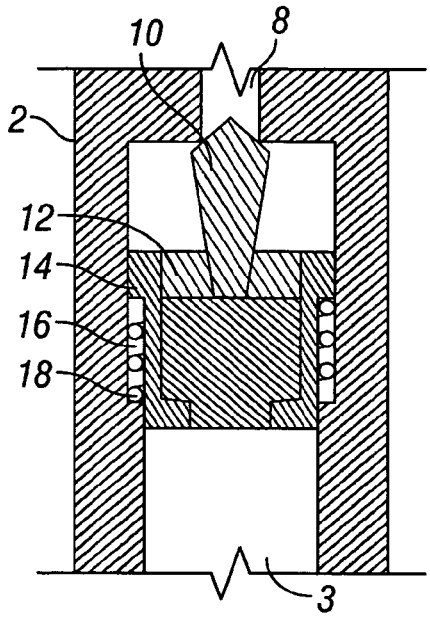
FIG. 2B (Prior Art)

FIGS. 2A and 2B are schematic cross-sectional views of a prior art dart valve useful in the invention positioned in a CT. (The same numerals are used throughout the drawing figures for the same parts unless otherwise indicated.) Illustrated in FIG. 2A is a coiled tubing wall 2 having a first, relatively narrow opening 8, and a second, relatively wider opening 3. Higher pressure fluid entering through opening 8 forces a dart 10 and its supports 12 and 14 to press down on a spring 18 in a channel 16, allowing fluid to flow through openings in support 12 and an opening 20 in support 14 and out through opening 3. FIG. 2B illustrates the close position, wherein spring 18 has sufficient force to overcome the fluid pressure entering through opening 8 and force dart 10 to seat and close opening 8. Higher pressure fluid entering opening 3 will also tend to force dart 10 to seat and close opening 8.

There are many varieties of check valves. Any and all known check valves and methods of using them are foreseeable functional equivalents and considered within the invention. One feature of the inventive apparatus and methods comprises a mechanical flow control system that only allows flow downhole through the tool, but that also can be overridden in the event that reverse circulation is desired. In order for the system to be safe, the override may be initiated and actuated from the well surface, or, in the absence of mechanical control from the well surface, locally initiated and actuated at the tool. If locally initiated and actuated, apparatus and methods of the invention may include a power source at the tool, so that the tool can shift to a safe position if communication is lost with surface. The type and capacity of the power source will vary depending on the actuation method used.

Figure 3:
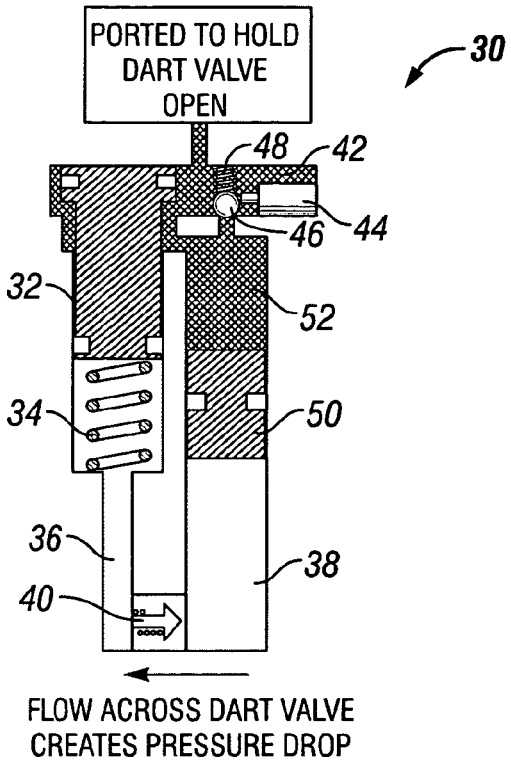
FIG. 3 is a schematic cross-sectional view of one possible hydraulic system useful in the apparatus and methods of the invention.

FIG. 3 is a schematic cross-sectional view of one possible hydraulic system 30 useful in apparatus and methods of the invention. System 30 may use pressure developed by, for example, a pump, to store hydraulic pressure in a high pressure chamber 42 that overrides closed check valves, such as a dart valve 40. The hydraulic pressure is released with a solenoid 44 that may be controlled by a downhole microprocessor (not shown). Solenoid 44, releases pressure if instructed to do so from the well surface, or, if communication with the surface is lost, by actuating a check valve using a local power source such as a battery. The main components of embodiment 30 are illustrated schematically in FIG. 3. In its up position, a pressure lock piston 32, forced up by a spring 34, allows hydraulic fluid to flow freely into a compensation chamber 52, so that there is no pressure differential across a check valve, which may be a ball 46 and spring 48 combination. In its down position, pressure lock piston 32 only allows flow across check valve 46/48 in one direction, from compensation chamber 52 into high pressure chamber 42. Pressure lock piston 32 is normally forced up by spring 34. When the hydraulic fluid pressure above pressure lock piston 32 is higher than the annulus (outside the tool) pressure below the piston (depicted as a low pressure chamber 36), spring 34 can be overridden and pressure lock piston 32 will move down. When a pressure differential is seen across check valve assembly 46/48, solenoid 44 is activated, causing its actuator to move toward ball 46 to roll ball 46 off its seat and release the pressure. A compensating piston 50 provides an adequate supply of hydraulic fluid for the system. Compensating piston 50 allows for direct pressure transfer from the tool ID (represented as a chamber 38) above dart valve 40 to the hydraulic fluid.

Figure 3A:
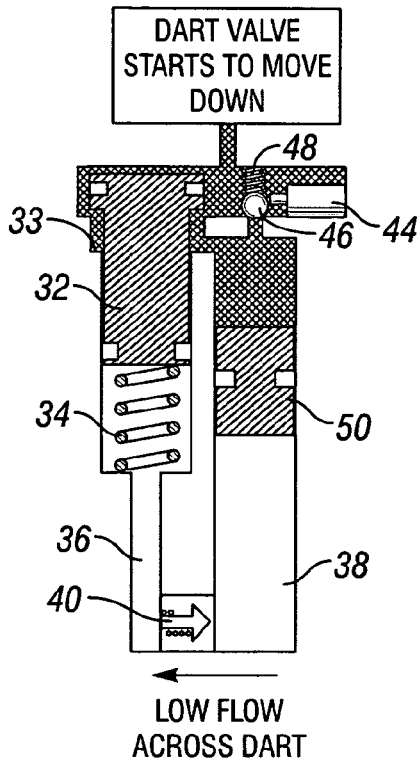
Figure 3B:
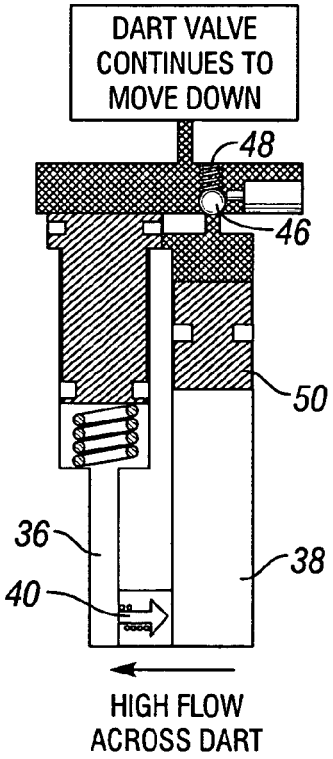
Figure 3C:
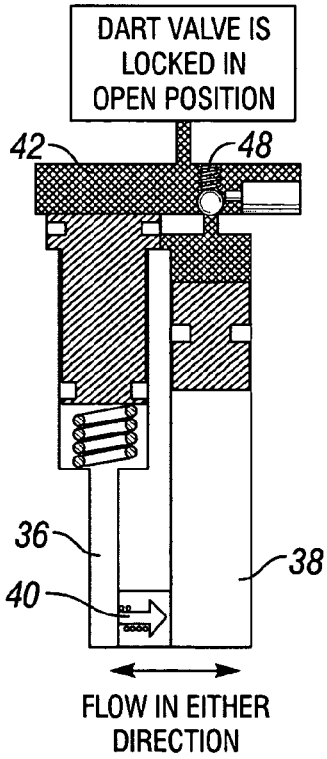
Figure 3D:
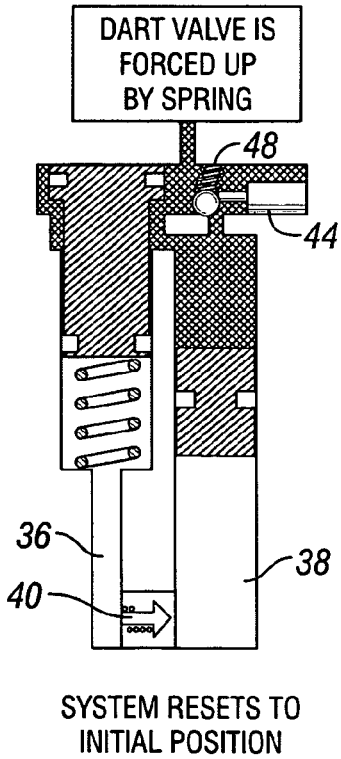
Figure 4C:
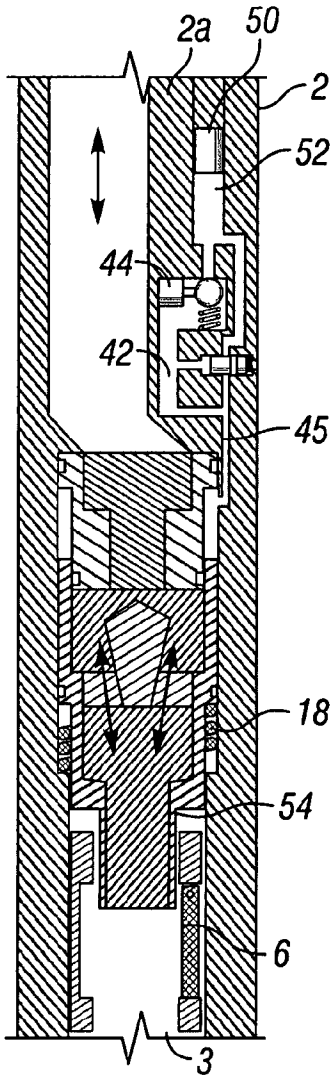
FIGS. 4A, 4B, and 4C are schematic cross-sectional views of a first apparatus embodiment of the invention on different modes of operation.
Figure 4B:
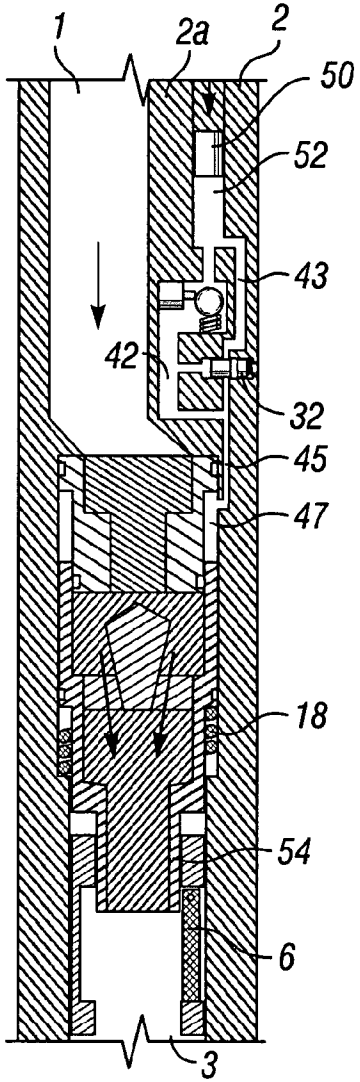
Figure 4A:
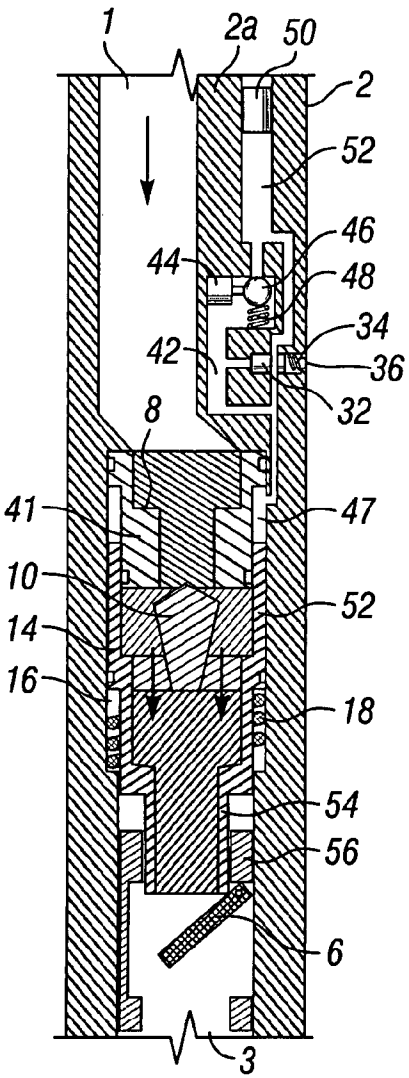

The basic operation of the hydraulic system of FIG. 3 is illustrated schematically in FIGS. 3A-3D, and its implementation into a tool or apparatus of the invention is illustrated schematically in FIGS. 4A-4C. FIGS. 3A, 3B, 3C, and 3D are schematic cross-sectional views of the hydraulic system of FIG. 3 in different modes of operation. In FIG. 3A there is a low flow across dart valve 40, and pressure lock piston 32 is in an intermediate position, balance by action of spring 34, and pressure in tool 38 caused by pumping and pressure in annulus 36. Solenoid 44 is deactivated to retract its actuator, and there is no pressure differential over check valve 46/48 (spring 48 is holding ball 46 against its seat). In FIG. 3B, dart valve 40 continues to open as flow increases across it, and pressure lock piston 32 seats, compressing spring 34. Note that the differential pressure that charges the hydraulic system need not be limited to that created by flowing across the dart valve and can be increased, for example, by adding a flow restriction (such as an orifice) below the dart valve. Compensating piston 50 moves upward, and some hydraulic fluid is allowed to enter high pressure chamber 42 by unseating ball 46. In FIG. 3C, compensating piston 50 is at its maximum travel upward, ball 46 seats, storing high pressure hydraulic fluid in high pressure chamber 42. When a pressure differential is seen across check valve assembly 46/48, solenoid 44 may be activated, either remotely or locally, allowing its actuator to extend to roll ball 46 off its seat and release the pressure, as depicted in FIG. 3D. If all communication is lost to the tool, solenoid 44 is activated locally, and its actuator extends to push ball 46 off of its seat.

FIGS. 4A, 4B, and 4C are schematic cross-sectional views of a first apparatus embodiment of the invention in different modes of operation. Illustrated are coiled tubing wall 2, an engineered section 2*a* of coiled tubing wall 2, and a hydraulic system as previously described in reference to FIGS. 3A-3D installed in engineered section 2*a*. Engineered section 2*a* may either be formed in the coiled tubing wall itself during fabrication of the coiled tubing, or comprise a piece retrofitted into coiled tubing 2. An opening 36 in CT wall 2 allows fluid communication with the annulus formed between wall 2 and the inside diameter of a well bore or well casing (not shown). FIG. 4A depicts the normal flow mode, where fluid traverses through CT opening at 1, in the direction of the arrow, through an opening 8 and channel in an upper dart valve member 41, past dart 10, through a sleeve 54, and finally past a flapper 6 of a flapper-style check valve.

Because of the nature of dart valve 40, a minimum pressure differential is necessary in order to flow across the valve. FIGS. 3A-3D show that this pressure differential charges the hydraulic system by creating a high pressure zone 42 above the valve and a low pressure zone below. Note that the differential pressure that charges the hydraulic system need not be limited to that created by flowing across the dart valve and can be increased, for example, by adding a flow restriction (such as an orifice) below the dart valve. The pressure differential begins to move compensating piston 50 to allow oil to flow above and shift dart valve 40 and flapper check valve. Also, the differential begins to move pressure lock piston 32 to its locked position. As the flow rate increases, as shown in FIG. 4B, pressure lock piston 32 continues to move down until the piston lands on a seat that prevents further movement. Just before pressure lock piston 32 seats, a seal takes place that prevents flow of oil around the piston. Additional oil flow due to added flow rate and greater pressure drop will now occur across the hydraulic check valve, 46/48. If flow stops after pressure lock piston 32 seats, pressure lock piston 32 will stay seated and hydraulic check valve 46/48 will prevent the charged oil from returning to compensation chamber 52. Consequently, the closed volume of oil in high pressure chamber 42, a passage 45, and annular chamber 47 above the dart valve will force it in the down position, which also forces the flapper check valve 6 open with a push sleeve 54. Once the system is charged and the pressure locked, flow can take place in both directions (as indicated by the double-headed arrow in FIG. 4C) across the flapper check valve and dart valve. When reverse circulation is completed, solenoid 44 is actuated to move ball 46 of the hydraulic check valve off its seat. In doing so, stored pressure in high pressure chamber 42 is released. The system returns to its original position, and flapper check valve 6 and dart 10 are returned to their normal position that prevents uphole flow.

Apparatus of the invention may be powered locally by battery, fuel cell, or other local power source. Apparatus of the invention may include a two-way communication link to the surface, which may be a fiber optic line, wire line, or wireless, that provides two-way communication that makes the valve operation easier and safer. For example, a position sensor may be used to signal to surface whether a dart of a dart valve is in the up or down position, or a flapper of a flapper-style check valve. The operator may then be confident that the valve is open before reverse circulating, and the operator may stop reversing flow if the valve closes inadvertently. Apparatus and methods of the invention may also employ a failsafe signal line from surface to downhole. If present, the operator may fire a light source to the tool if reversing mode is desired. If the operator decides to stop reversing, or if the signal line is damaged or broken, the failsafe light source is removed. When this is detected at the tool, the tool automatically releases the hydraulic pressure in high pressure chamber 42 and returns the system to a safe position. In other words, even if the communications link is broken and the operator cannot pump or manipulate the CT (e.g. parted CT), the tool will still return to a safe position and prevent uphole flow of well fluids.

This feature provides a benefit over known reversing valves, which require either pumping or CT manipulation to return to a safe mode.

Apparatus of the invention may be described as intrinsically safe. In other words, if communication and control from surface are lost, apparatus of the invention return to safe mode and prevent uphole flow. Certain embodiments may use only one solenoid to operate a hydraulic system; in these embodiments, the apparatus is charged by a pressure drop across the dart valve. Other actuation arrangements are possible, however, that also return to a safe mode in the absence of intervention from surface. Two examples of alternate actuation methods are described below. These are presented as an overall picture of the types of actuators and actuation methods available and should only be considered as representative non-limiting examples.

Figure 5:
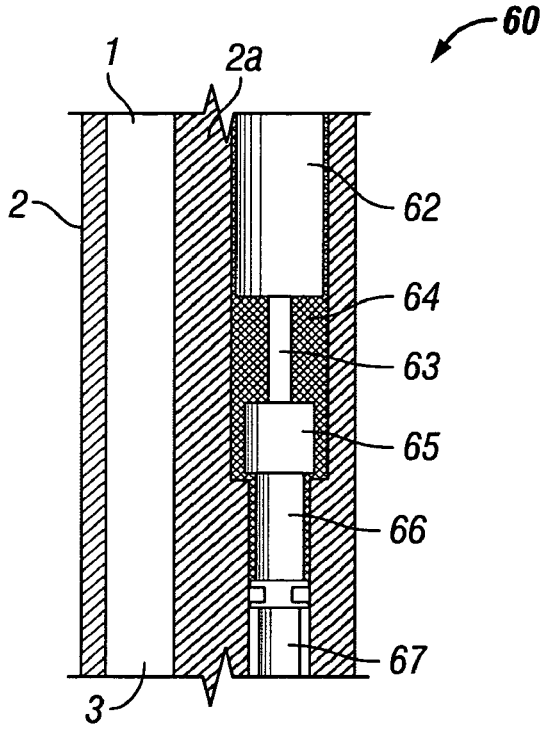
FIGS. 5 and 6 are schematic cross-sectional views of apparatus of the invention comprising motor and dual solenoid actuators, respectively.
Figure 7:
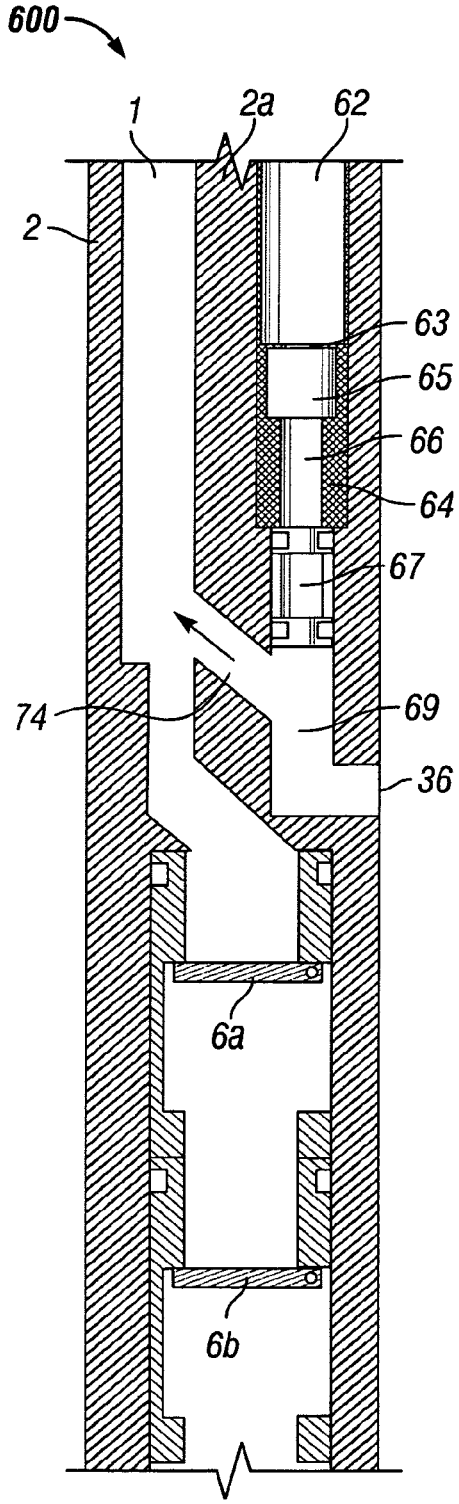
FIGS. 7-14 are schematic cross-sectional views of other apparatus embodiment of the invention.

A motor may be used that produces a linear stroke to move the tool between conventional and reversing positions. A motor 62 might be packaged in tools of the invention as illustrated in embodiments 60 and 600 of FIGS. 5 and 7, respectively. Motor 62 may be adapted to have a linear motion drive shaft 63 attached to a piston head 65 of a movable valve gate 66. An annulus bypass piston 67 is adapted to move into and out of a flow bypass chamber 69, as depicted in FIG. 7. Note that an oil compensation system 64 may be used to protect and lubricate the motor, gears, and other mechanical parts 63, 64, 65, 66, and 67. Alternatively, these parts may be comprised of frictionless coatings. As illustrated in embodiment 600 of FIG. 7, as motor 62 is activated by an operator, it moves shaft 63, piston head 65, valve gate 66, and annulus bypass piston 67 down, effectively closing a bypass formed by opening 36, chamber 69, and a bypass conduit 74. During a reverse flow operation, since the pressure in the annulus is greater than the pressure in coiled tubing 2, flappers 6*a* and 6*b* will close and restrict flow through the flappers. However, the described bypass, referred to as an annular bypass, allows a reverse cleaning procedure, as debris will flow through opening 36, chamber 69, bypass conduit 74, and CT main flow conduit 1. When it is desired to stop reverse flow, or power is lost to the tool, motor 62 is energized by a back-up power source (not illustrated), forcing annulus bypass piston 67 down, blocking any flow from the annulus through opening 36, chamber 69, bypass conduit 74, and upward through CT main flow conduit 1.

Figure 6:
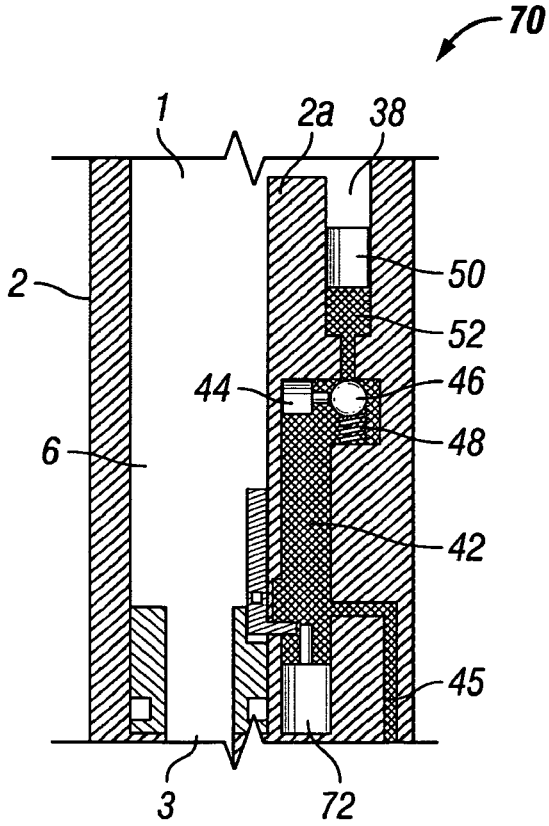
Figure 8:
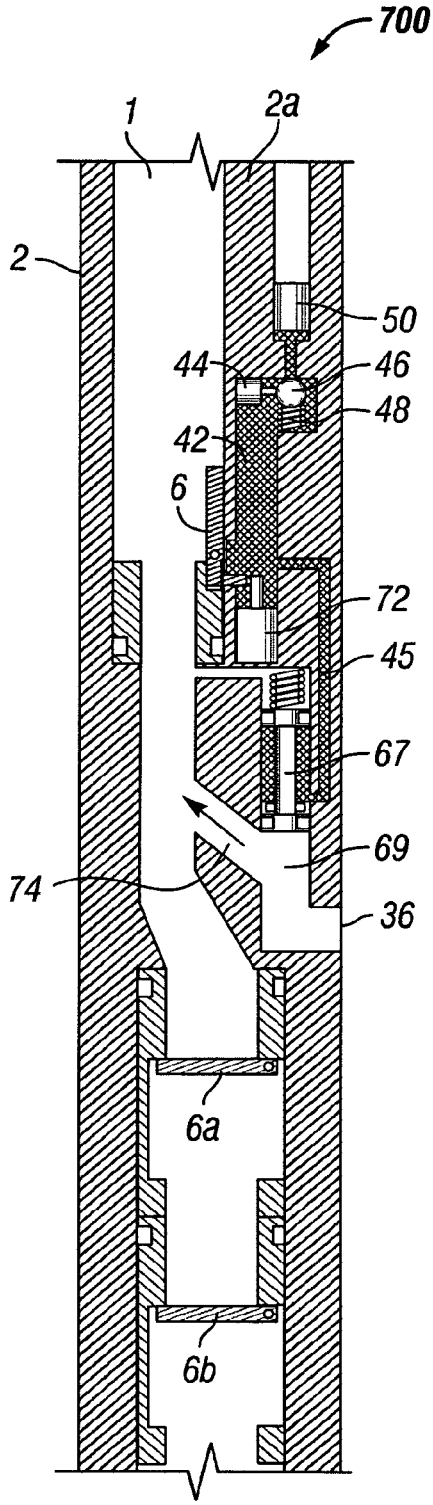

As one alternative annular bypass apparatus and method, apparatus and methods of the invention may comprise two or more solenoids to actuate the reversing tool, as illustrated schematically in embodiments 70 and 700 of FIGS. 6 and 8, respectively. A first solenoid, 72, may selectively close the flapper of check valve 6 to create a high pressure differential and charge the hydraulic system high pressure chamber 42, as illustrated conceptually FIGS. 6 and 8. FIG. 8 illustrates schematically how a dual solenoid arrangement could be used in conjunction with a hydraulic system. Second solenoid 44 may be adapted to release the stored hydraulic pressure, as previously described, while first solenoid 72, in deactivated state as illustrated in FIGS. 6 and 8, selectively closes check valve 6 to charge the hydraulic system and allow reverse flow (upward) of well debris and fluids. When it is desired to stop reverse flow, or power is lost to the tool, second solenoid 44 is energized by a back-up power source, releasing the stored pressure and returning the system to a safe mode.

While the annular bypass apparatus and method embodiments have been described as using a motor or dual solenoid system to operate the reversing tools of the invention, the invention is not so limited. Any component or collection of components that function to allow selectively opening and closing the path to the annulus may be employed. When the path to the annulus is open, and pressure in the annulus is greater than pressure in the CT, fluid and any solid debris may bypass the check valves and flow up the CT.

Figure 9:
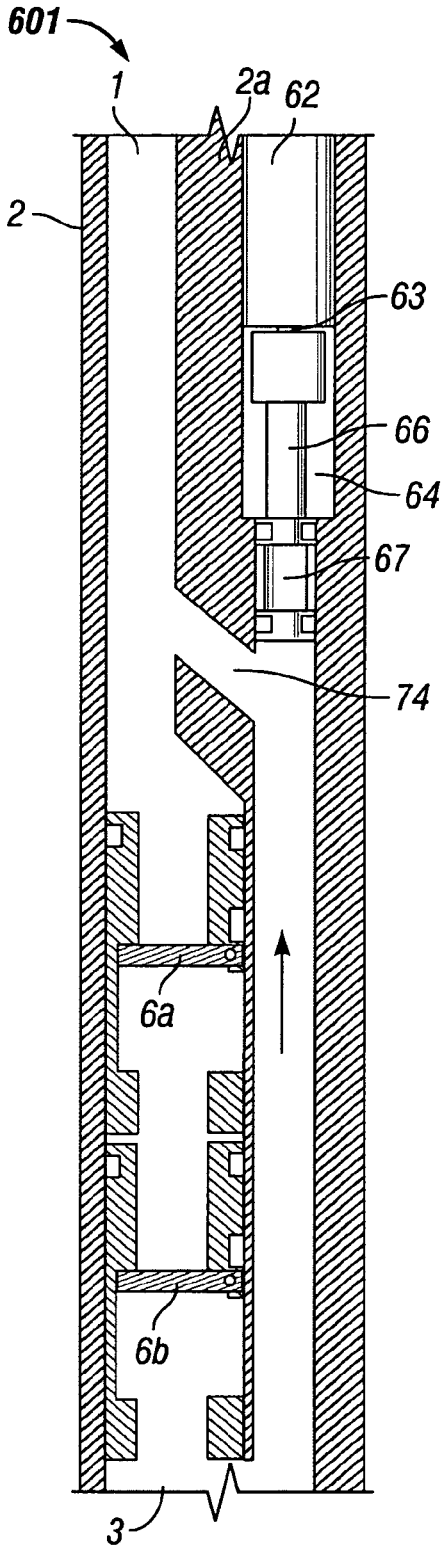
Figure 10:
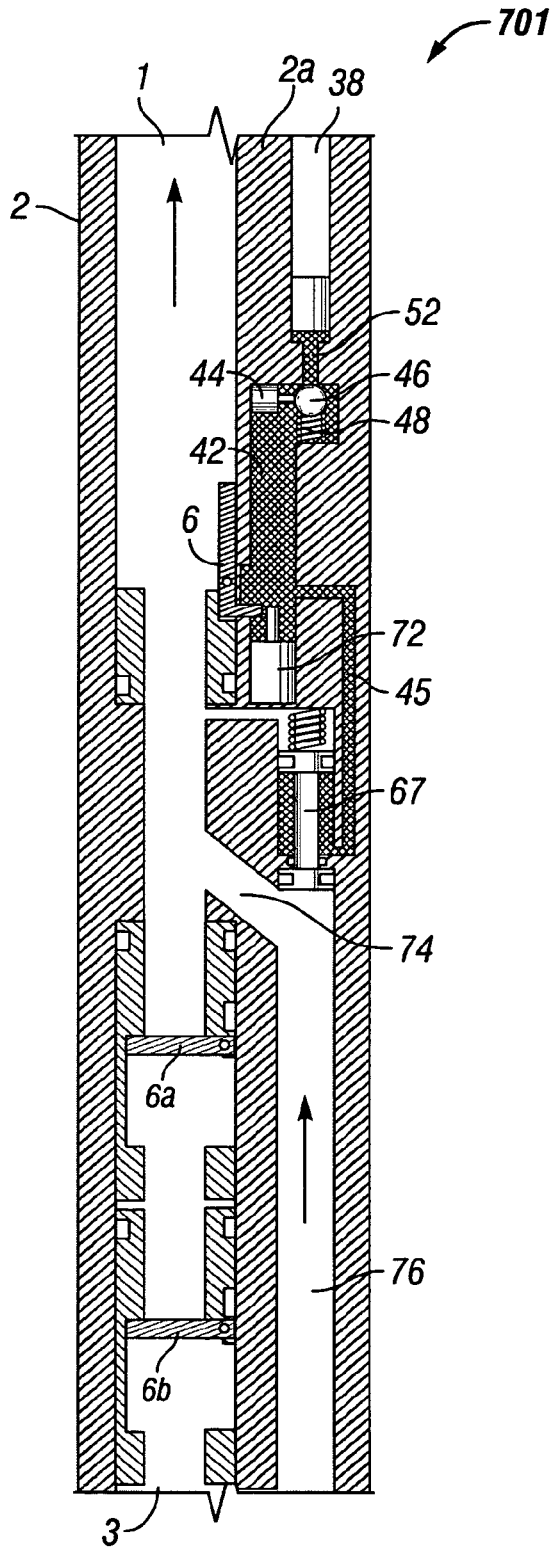

The motor and dual solenoid arrangements may be used in inline bypass arrangements as illustrated in embodiments 601 and 701 in FIGS. 9 and 10, respectively, in a manner similar to the annulus bypass apparatus described in reference to FIGS. 7 and 8. However, for inline bypass apparatus, the uphole flow does not enter the tool directly from the annulus, but rather travels up the tool from within through a second CT flow channel 76, as indicated by the arrows in FIGS. 9 and 10. Otherwise, apparatus of the invention including inline bypasses of FIGS. 9 and 10 operate similarly in concept to the annulus bypass embodiments of FIGS. 7 and 8.

Figure 11:
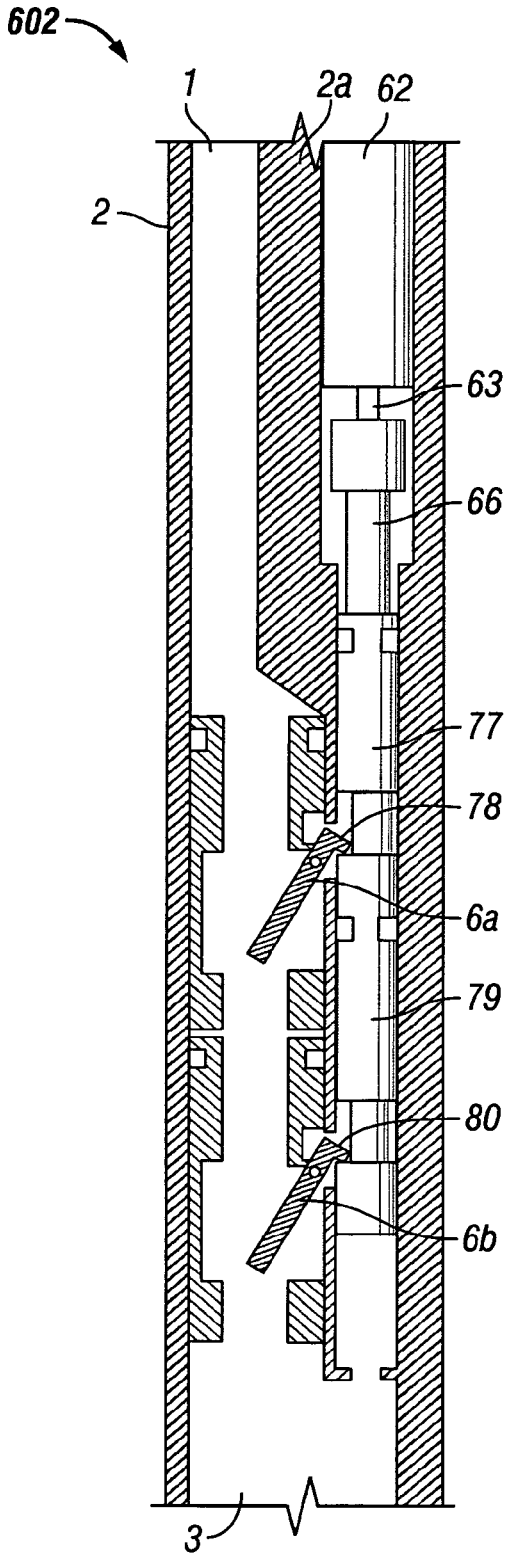
Figure 12:
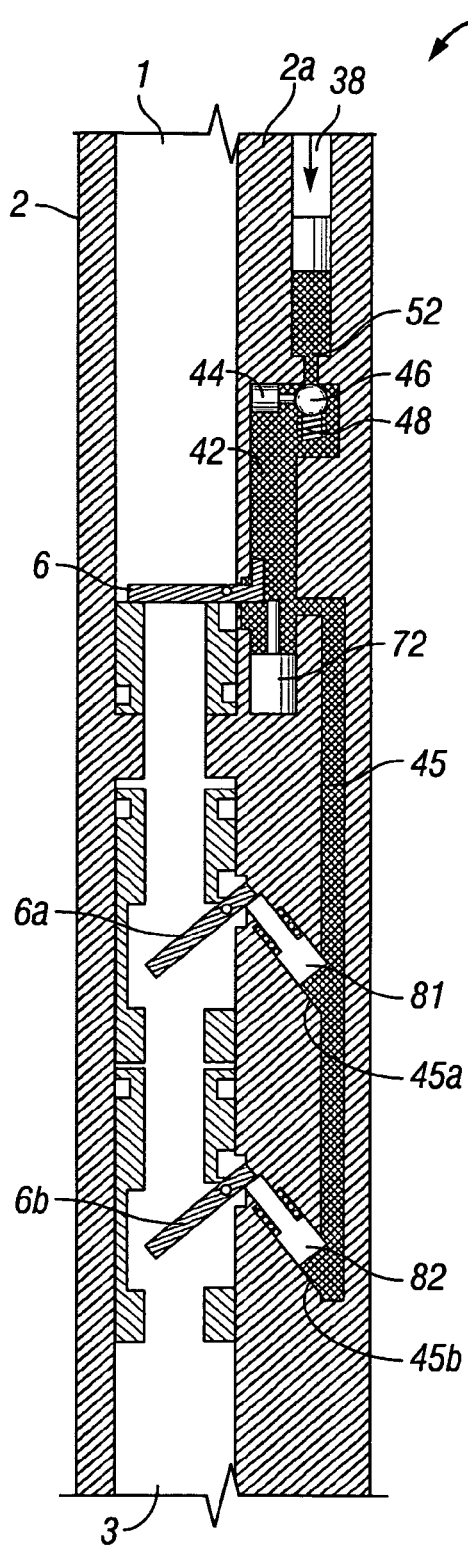

FIGS. 11 and 12 illustrate how the two actuation arrangements may be used to directly override two flapper-style check valves, allowing uphole flow. The assembly illustrated schematically in FIG. 11, may include a motor 62, motor shaft 63, and movable valve gate 66, which now moves dual flapper actuators 77 and 79, each having a notch 78 and 80, respectively. Movement up of shaft 63, gate 66, actuators 77 and 79, and notches 78 and 80 mechanically opens flappers 6*a* and 6*b*, allowing reverse flow. The assembly in FIG. 12 uses dual solenoids 72 and 44 to charge the hydraulic system and release the pressure. When the hydraulic system is charged, the hydraulic pressure in conduits 45, 45*a*, and 45*b* shifts pistons 81 and 82, mechanically opening flappers 6*a* and 6*b*. When it is desired to stop reverse flow, or power or communication is lost, solenoid 44 is activated, releasing hydraulic pressure in conduits 45, 45*a*, and 45*b*, allowing flappers 6*a* and 6*b* to close in safe position.

Figure 13:
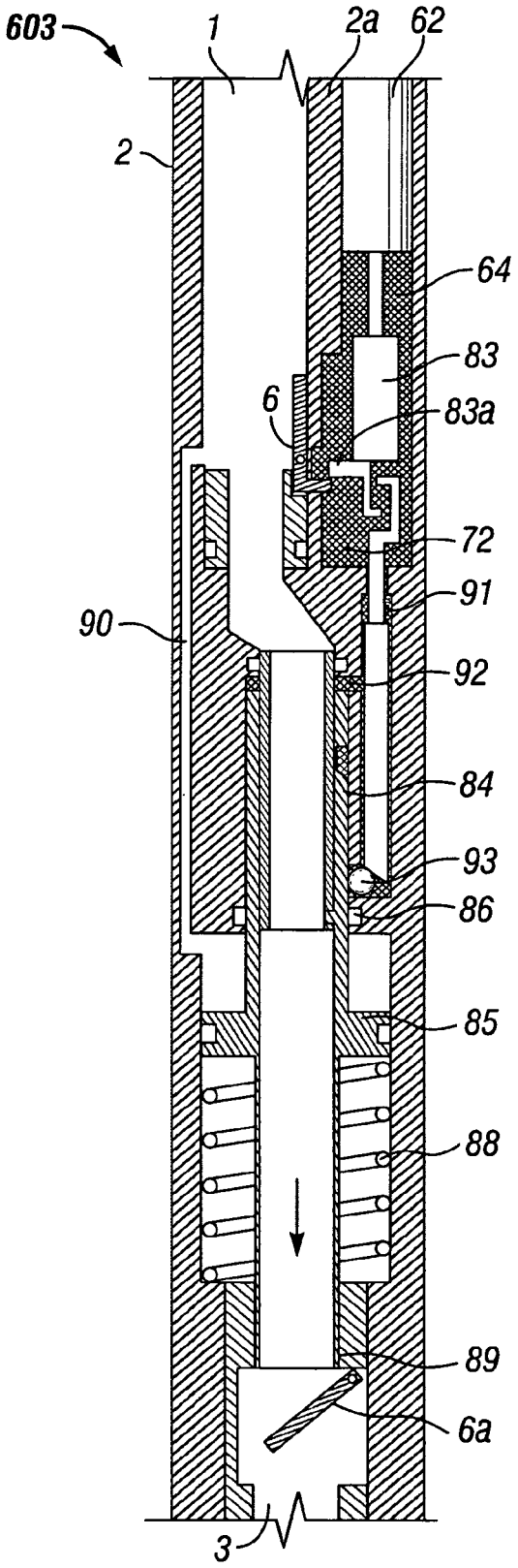
Figure 14:
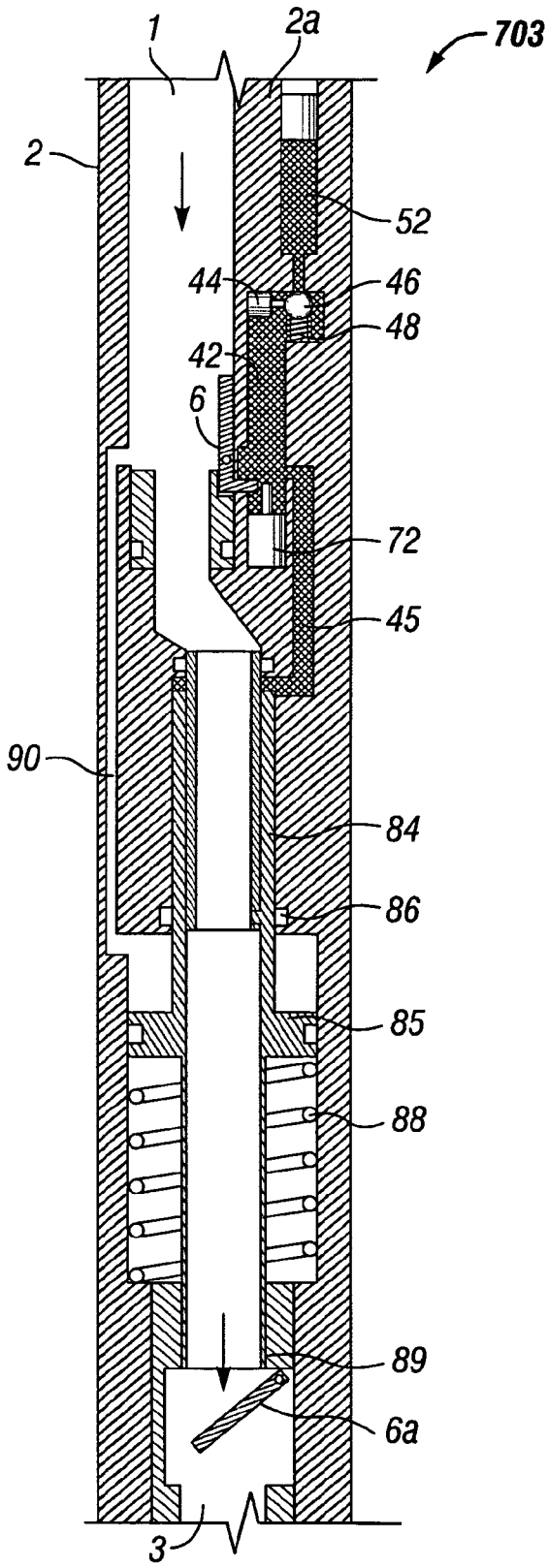

Two other embodiments 603 and 703 that may utilize either a motor (embodiment 603) or a dual-solenoid (embodiment 703) actuation system are illustrated schematically in FIGS. 13 and 14. Both actuation systems utilize stored hydraulic pressure to shift a sleeve that overrides two flapper check valves (only one shown due to space constraints). For the motor assembly illustrated in FIG. 13, motor 62 may have a first motor position that closes hydraulic flapper valve 6 and charges hydraulic system 64 and 91, moving a push sleeve 84 down against spring pressure by a push sleeve spring 88 against a flange 85 connected to sleeve 84, until a locking pin 93 pops into place on push sleeve 84. Push sleeve 84 may be guided by a bearing 86, and a distal end 89 of push sleeve 84 pushes open flappers 6*a* and 6*b* (the latter not shown). Then, by pulling up with motor 62 to a second motor position, locking pin 93 releases, and push sleeve 84 returns to its starting position by action of push sleeve spring 88, and flappers 6*a* and 6*b* close. The system in FIG. 14 may use dual solenoids 72 and 44 to store and release hydraulic pressure in high pressure chamber 42 and conduit 45. When charged, the hydraulic system holds push sleeve 84 and push sleeve flange 85 down, overriding push sleeve spring 88 and causing flapper check valves 6*a* and 6*b* (the latter not shown due to space limitations) down. When upper solenoid 44 releases the pressure, push sleeve 84 returns to its original position. In both embodiments 603 and 703, a passageway 90 may be provided to equalize pressure and provide lubricant.

An optional feature of apparatus of the invention is one or more sensors located at the tool to detect the presence of hydrocarbons (or other chemicals of interest) in the fluid traversing up CT main passage 2 during a reverse flow procedure. The chemical indicator may communicate its signal to the surface over a fiber optic line, wire line, wireless transmission, and the like. When a certain chemical is detected that would present a safety hazard if allowed to reach surface (such as oil or gas), the reversing system is returned to its safe position, long before the chemical creates a problem.

Figure 15:
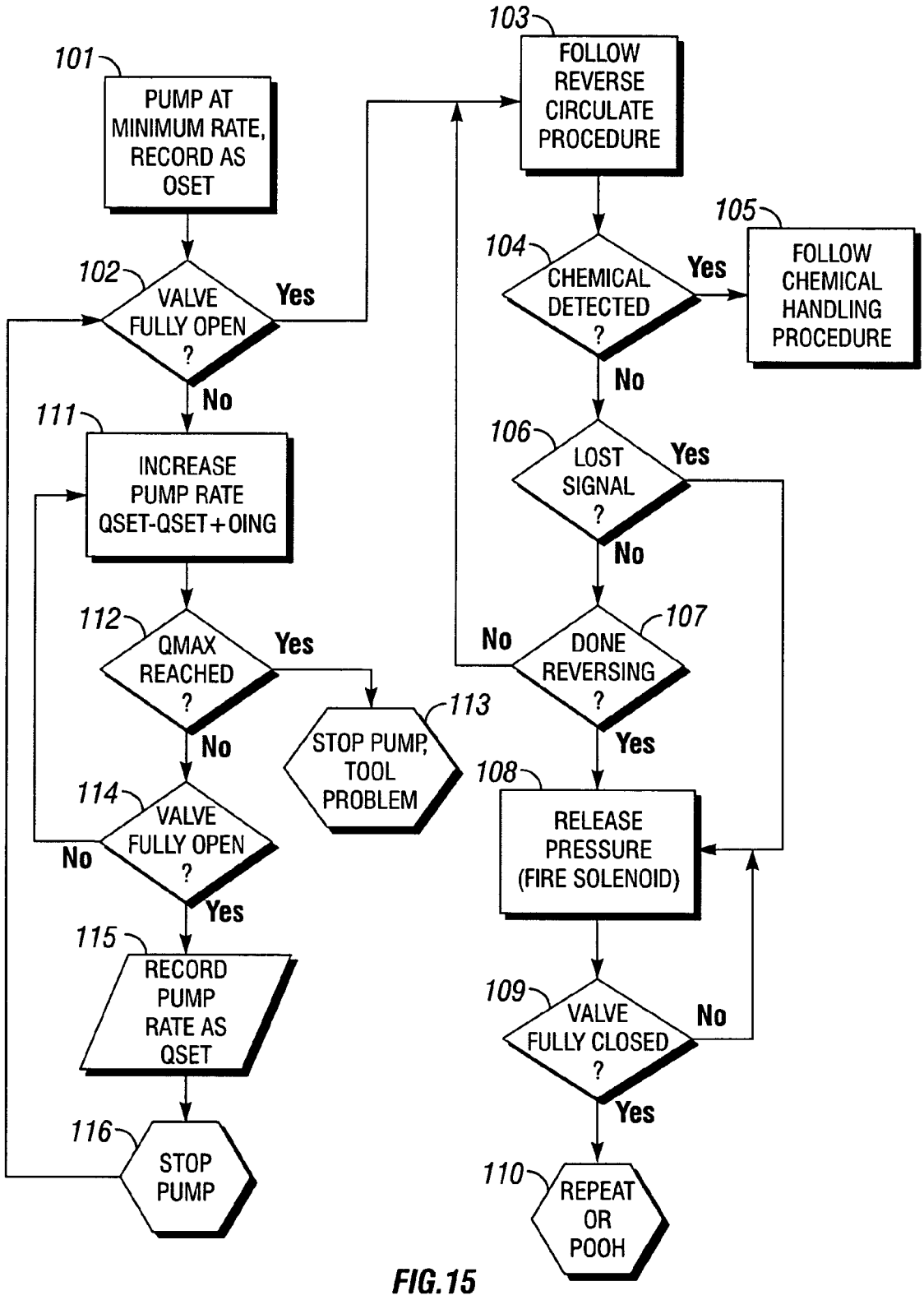
FIG. 15 is a logic diagram illustrating some of the features of the invention.

An overall operating process logic diagram for using apparatus of the invention is illustrated in FIG. 15. This operational flow diagram may include chemical detection at the tool. FIG. 15 illustrates not only how easy the system is to operate, but also how the two main safety risks, lost tool/surface communication and hydrocarbon (for example) entry into the tool, are mitigated. In the first box, 101, a pump providing hydraulic pressure is set at minimum rate and recorded as QSET. A microprocessor, or the operator, asks if the valve is fully open, represented by question box 102. If yes, a reverse circulate flow procedure is followed, as indicated at 103. Continuing this line of logic, the method may ask, at 104, if chemical is detected. If yes, a chemical handling procedure s followed, represented buy box 105. If no chemical is detected, the method may ask if the signal is lost from the surface at 106. If yes, for safe operation pressure is released at 108, and if no, the process asks if reversing is completing ay 107. If reversing is complete, pressure is released at 108 by firing a solenoid. If reversing is not complete, the process and apparatus continue to follow the reverse circulation procedure indicated at box 103. After pressure is released when reversing is complete, the logic asks if the valve is fully closed. If not, the solenoid is fired again until reverse flow stops. The apparatus repeats the procedure, as indicated by box 110. Returning to box 102, if the valve is not fully opened using the QSET pump pressure, the pump rate is increased, as indicated at box 111. The logic asks if the pump maximum flow rate, QMAX, has been reached, at 112. If yes, the pump is stopped and the conclusion is reached that there must be a problem at the tool, indicated at box 113. If QMAX has not been reached, the logic again asks if the valve is now fully open, as indicated at box 114. If yes, the pump rate at which the valve is fully open is recorded as QSET at 115, and the pump is stopped at 116. Those of skill in the art will recognized many options, and possible and foreseeable variations in the logic, and these variations are considered within the scope of the invention.

A typical use of this invention will be in situation when a normal clean out using coiled tubing is or will become more difficult as a well bore becomes too large in diameter, causing the annulus to be too wide. In these situations, forcing cleaning fluid down the CT will not normally produce high enough rate in the annulus to force the fluid and debris out of the well bore. Apparatus of the invention may then be employed to "reverse the flow". Cleaning fluids are pumped down the annulus, and one of the apparatus and method embodiments of the invention employed to reverse flow upwards through the CT.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. An apparatus comprising:

(a) a section of coiled tubing having a main flow channel;

(b) at least one flow-preventing valve in the section of coiled tubing, adapted to close the main flow channel and prevent flow through the coiled tubing upon attempted flow reversal;

(c) a chemical detector; and (d) at least one actuator adapted to deter closing of the flow-preventing valve.

2. The apparatus of claim 1 including a power source adapted to act on the at least one actuator and allow return to a safe mode of operation by closing the at least one flow-preventing valve.

3. The apparatus of claim 1 wherein the at least one actuator is selected from motor and solenoid actuators.

4. The apparatus of claim 3 comprising a hydraulic system used in conjunction with the at least one actuator.

5. The apparatus of claim 1 comprising surface/apparatus communication through one or more communication links.

6. the apparatus of claim 1 wherein the flow-preventing valve is selected from flapper-type check valves and dart valves.

7. The apparatus of claim 1 wherein the chemical detector comprises a hydrocarbon detector.

8. The apparatus of claim 4 wherein the hydraulic system includes a pressure lock piston and pressure lock spring combination.

9. The apparatus of claim 8 wherein the pressure lock piston is adapted to be forced to a first position by the pressure lock spring, allowing hydraulic fluid to flow freely into a compensation chamber, so that there is no pressure differential across a hydraulic fluid check valve.

10. The apparatus of claim 9 wherein the hydraulic fluid check valve is a ball and spring combination.

11. The apparatus of claim 9 wherein the pressure lock piston is adapted to move to a second position, wherein the pressure lock piston only allows flow across the hydraulic fluid check valve in one direction, from the compensation chamber into a high pressure chamber.

12. The apparatus of claim 9 wherein the pressure lock piston, normally forced to its first position by the pressure lock spring, is adapted to move to the second position when the hydraulic fluid pressure above pressure lock piston is higher than an annulus pressure below the piston, allowing the pressure lock spring to be overridden.

13. The apparatus of claim 10 wherein when a pressure differential is seen across the hydraulic fluid check valve, a solenoid is activated, causing its actuator to move toward the ball to roll the ball off its seat and release the hydraulic pressure.

14. The apparatus of claim 8 comprising a compensating piston adapted to provide an adequate supply of hydraulic fluid for the hydraulic system.

15. The apparatus of claim 4 wherein the at least one actuator is a motor adapted to produce a linear stroke to move a linear motion drive shaft attached to a piston head of a movable valve gate, and an annulus bypass piston adapted to move into and out of an annular flow bypass chamber, allowing a reverse cleaning procedure through the coiled tubing main flow channel, bypassing the at least one flow-preventing valve.

16. The apparatus of claim 4 wherein the at least one actuator comprises a first solenoid, adapted to selectively create a high pressure differential and charge the hydraulic system to selectively allow reverse flow of well debris and fluids through the main flow channel, bypassing the at least two flow-preventing valves, and a second solenoid adapted to release the stored hydraulic pressure when desired.

17. The apparatus of claim 4 wherein the at least one actuator is a motor adapted to produce a linear stroke to move a linear motion drive shaft attached to a piston head of a movable valve gate, and an annulus bypass piston adapted to move into and out of an inline flow bypass chamber, allowing a reverse cleaning procedure through a second coiled tubing flow channel, bypassing the at least one flow-preventing valve.

18. The apparatus of claim 4 wherein the at least one actuator comprises a first solenoid, adapted to selectively create a high pressure differential and charge the hydraulic system to selectively allow reverse flow of well debris and fluids through a second coiled tubing flow channel, bypassing the at least two flow-preventing valves, and a second solenoid adapted to release the stored hydraulic pressure when desired.

19. The apparatus of claim 4 wherein the at least one actuator is a motor adapted to produce a linen stroke to move a linear motion drive shaft attached to a piston head of a movable valve gate, and dual flapper actuators and, each having a notch and allowing a reverse cleaning procedure through the main coiled tubing flow channel, overriding the at least one flow-preventing valve.

20. The apparatus of claim 4 wherein the at least one actuator comprises a first solenoid, adapted to selectively create a high pressure differential and charge the hydraulic system to selectively actuate one or more pistons to allow reverse flow of well debris and fluids through the main coiled tubing flow channel, overriding the at least two flow-preventing valves, and a second solenoid adapted to release the stored hydraulic pressure when desired.

21. The apparatus of claim 4 wherein the at least one actuator is a motor adapted to have a first motor position that closes a hydraulic flapper valve and charge the hydraulic system, the hydraulic system adapted to move a push sleeve against spring pressure exerted by a push sleeve spring against a flange connected to the sleeve, the push sleeve having a distal end adapted to push open the flow-preventing valves.

22. The apparatus of claim 4 wherein the at least one actuator comprises a first solenoid adapted to close a hydraulic flapper valve and charge the hydraulic system, the hydraulic system adapted to move a push sleeve against spring pressure exerted by a push sleeve spring against a flange connected to the sleeve, the push sleeve having a distal end adapted to push open the two or more flow-preventing valves, and a second solenoid adapted to selectively release the hydraulic pressure and return push sleeve to its original position.

23. A reversing tool comprising:

(a) a section of coiled tubing having a main flow channel;

(b) at least one flow-preventing valve in the section of coiled tubing, adapted to close the main flow channel and prevent flow through the coiled tubing upon attempted flow reversal;

(c) a chemical detector;

(d) at least one actuator adapted to deter closing of the flow-preventing valve;

(e) a hydraulic system used in conjunction with the at least one actuator; and (f) a local power source adapted to de-pressurize the hydraulic system in the event of power or communications failure.

24. The reversing tool of claim 23 wherein the at least one actuator is a motor adapted to produce a linear stroke to move a liner motion drive shaft attached to a piston head of a movable valve gate, and an annulus bypass piston adapted to move into and out of an annular flow bypass chamber, allowing a reverse cleaning procedure through the coiled tubing main flow channel, bypassing the at least one flow-preventing valve.

25. The reversing tool of claim 23 wherein the at least one actuator comprises a first solenoid, adapted to selectively create a high pressure differential and charge the hydraulic system to selectively allow reverse flow of well debris and fluids through the main flow channel, bypassing the at least two flow-preventing valves, and a second solenoid adapted to release the stored hydraulic pressure when desired.

26. The reversing tool of claim 23 wherein the at least one actuator is a motor adapted to produce a linear stroke to move a liner motion drive shaft attached to a piston head of a movable valve gate, and an annulus bypass piston adapted to move into and out of an inline flow bypass chamber, allowing a reverse cleaning procedure through a second coiled tubing flow channel, bypassing the at least two flow-preventing one flow-preventing valve.

27. The reversing tool of claim 23 wherein the at least one actuator comprises a first solenoid, adapted to selectively create a high pressure differential and charge the hydraulic system to selectively allow reverse flow of well debris and fluids through a second coiled tubing flow channel, bypassing the at least two flow-preventing valves, and a second solenoid adapted to release the stored hydraulic pressure when desired.

28. The reversing tool of claim 23 wherein the at least one actuator is a motor adapted to produce a linear stroke to move a linear motion drive shaft attached to a piston head of a movable valve gate, and dual flapper actuators and, each having a notch and allowing a reverse cleaning procedure through the main coiled tubing flow channel, overriding the at least one flow-preventing valve.

29. The reversing tool of claim 23 wherein the at least one actuator comprises a first solenoid, adapted to selectively create a high pressure differential and charge the hydraulic system to selectively actuate one or more pistons to allow reverse flow of well debris and fluids through the main coiled tubing flow channel, overriding the at least two flow-preventing valves, and a second solenoid adapted to release the stored hydraulic pressure when desired.

30. The reserving tool of claim 23 wherein the at least one actuator is a motor adapted to have a first motor position that closes a hydraulic flapper valve and charge the hydraulic system, the hydraulic system adapted to move a push sleeve against spring pressure exerted by a push sleeve spring against a flange connected to the sleeve, the push sleeve having a distal end adapted to push open the flow-preventing valve.

31. The reversing tool of claim 23 wherein the at least one actuator comprises a first solenoid adapted to close a hydraulic flapper valve and charge the hydraulic system, the hydraulic system adapted to move a push sleeve against spring pressure exerted by a push sleeve spring against a flange connected to the sleeve, the push sleeve having a distal end adapted to push open the two or more flow-preventing valves, and a second solenoid adapted to selectively releases the hydraulic pressure and return push sleeve to its original position.

32. The reversing tool of claim 23 wherein the chemical detector comprises a hydrocarbon detector.

33. A method comprising:

(a) inserting a coiled tubing having a main flow channel into a bore hole, the coiled tubing comprising a section of coiled tubing having at least one flow-preventing valve;

(b) flowing a fluid through an annulus between the coiled tubing and the well bore;

(c) reversing flow through the coiled tubing by actuating at least one actuator to deter closing of the flow-preventing valves; and (d) detecting one or more chemicals in the reversed flow.

34. The method of claim 33 wherein detecting comprises detecting chemicals with a chemical detector.

35. The method of claim 34 wherein the detecting comprises detecting chemicals with a hydrocarbon detector.

* * * * *

UNITED STATES PATENT AND TRADEMARK OFFICE

CERTIFICATE OF CORRECTION

PATENT NO. : 7,614,452 B2
APPLICATION NO. : 11/151605
DATED : November 10, 2009
INVENTOR(S) : Kenison et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 794 days.

Signed and Sealed this

Nineteenth Day of October, 2010

David J. Kappos

David J. Kappos
*Director of the United States Patent and Trademark Office*